US007533779B2

(12) United States Patent
Willim

(10) Patent No.: US 7,533,779 B2
(45) Date of Patent: May 19, 2009

(54) LATTICE MAST CRANE WITH A DERRICK BOOM

(75) Inventor: Hans-Dieter Willim, Ulm-Unterweiler (DE)

(73) Assignee: Liebherr-Werk Ehingen, Ehingen/Donau (DE)

( * ) Notice: Subject to any disclaimer, the term of this patent is extended or adjusted under 35 U.S.C. 154(b) by 36 days.

(21) Appl. No.: 11/881,720

(22) Filed: Jul. 27, 2007

(65) Prior Publication Data

US 2008/0061022 A1 Mar. 13, 2008

(30) Foreign Application Priority Data

Jul. 28, 2006 (DE) ..... 20 2006 011 608 U

(51) Int. Cl.
*B66C 23/76* (2006.01)

(52) U.S. Cl. ..... 212/195; 212/196; 212/198

(58) Field of Classification Search ..... 212/195–198
See application file for complete search history.

(56) References Cited

U.S. PATENT DOCUMENTS

| | | | | |
|---|---|---|---|---|
| 1,195,058 | A * | 8/1916 | Marfell | 212/196 |
| 1,575,687 | A * | 3/1926 | Hollick | 212/279 |
| 2,092,122 | A | 9/1937 | Joyce | |
| 3,750,895 | A * | 8/1973 | Durand | 212/198 |
| 3,836,010 | A * | 9/1974 | Lampson | 212/195 |
| 3,868,022 | A * | 2/1975 | Greenlay et al. | 212/291 |
| 4,258,852 | A | 3/1981 | Juergens | |
| 4,316,548 | A * | 2/1982 | Helm et al. | 212/196 |
| 4,349,115 | A * | 9/1982 | Lampson | 212/178 |
| 4,729,486 | A | 3/1988 | Petzold et al. | |

FOREIGN PATENT DOCUMENTS

| | | | |
|---|---|---|---|
| DE | 296 07 257 | | 7/1996 |
| DE | 199 44 927 | | 3/2001 |
| EP | 0 379 448 | A1 * | 1/1990 |
| EP | 0 379 448 | A1 * | 7/1990 |
| JP | 2001-206674 | | 7/2001 |
| JP | 2004-002002 | | 1/2004 |
| SU | 1348294 | A1 * | 12/1985 |

* cited by examiner

*Primary Examiner*—Thomas J. Brahan
(74) *Attorney, Agent, or Firm*—Dilworth & Barrese, LLP

(57) ABSTRACT

The present invention relates to a lattice mast crane having a traveling gear, a swiveling crown arranged on the traveling gear and a revolving deck which is rotatable via the swiveling crown and on which a main boom and a derrick boom are arranged and having a ballast box, with the revolving deck being mounted on the swiveling crown via a spacer tube and with the guide frame forming the track of the derrick ballast projecting outwardly beyond the ballast box.

20 Claims, 2 Drawing Sheets

LATTICE MAST CRANE WITH A DERRICK BOOM

BACKGROUND OF THE INVENTION

The invention relates to a lattice mast crane with a derrick boom.

With lattice mast cranes, a swiveling crown is usually arranged on a traveling gear and a revolving deck is rotatably supported on said swiveling crown. The revolving deck supports a main boom and a derrick boom. A ballast box is usually provided for the reception of the ballast.

Such a lattice mast crane with a derrick device and a ballast box should be able to be used on a dam to sink heavy concrete blocks having a weight of approximately 150 t in the sea with a radius of up to 115 m. Such concrete blocks are stacked in front of the dam as wave protection. On use on the dam, the problem results that the radius required for the moment distribution in a lattice mast crane with a ballast box would be so large that the dam crest width available for the movement of the lattice mast crane is not sufficient.

The problem furthermore exists that on the use of a lattice mast crane with a ballast box, the total width of the dam crest is blocked by the undercarriage, the ballast box and the connecting rods arranged between the superstructure and the ballast box. This is, however, not desirable since, when a crane is used, a sufficient passage width for the construction site traffic on the dam crest must be left free.

SUMMARY OF THE INVENTION

It is the object of the present invention to provide a lattice mast crane which can also be used on a dam crest for the transfer of heavy loads, with it simultaneously being ensured that the construction site traffic can go on despite the use of the lattice mast crane.

This object is solved in accordance with the invention by the combination of the features herein. For this purpose, the revolving deck is mounted on the swiveling crown via a spacer tube. The ballast box can hereby be connected to the lattice mast crane via a high-set linkage such that a passageway for construction site vehicles is produced beneath the connecting rods between the traveling gear of the lattice mast crane and the ballast box.

Preferred embodiments of the invention also result from the description herein.

A guide frame can thus advantageously be hinged to the spacer tube and the ballast box is connected thereto via a spacer frame.

The spacer frame, which is usually fixedly connected to the guide frame, can be connected to the ballast box via a single rotary axle. The ballast box is hereby rotatable with respect to the guide frame on an inclined position of the ballast box due to uneven ground.

The guide frame can particularly advantageously project beyond the ballast box. Since ballast can be deposited on the guide frame, a large resisting moment can be generated despite a comparatively tight ballast box radius.

A stewing gear transmission can preferably be arranged in the lower region of the spacer tube.

A carriage for the reception of the derrick ballast can be provided on the guide frame. The carriage can advantageously be displaceable by means of rollers on rails fastened to the guide frame. Other sliding members such as skids can also be used instead of the rollers. The guide frame can be divided at least into two for simpler transportability.

The guide frame is preferably connected to the head piece of the derrick boom by a fixed guying. In accordance with a further advantageous embodiment of the invention, at least two ropes fastened to the main boom to the right and to the left with respect to the axis of symmetry of the crane are guided to the guide frame via rollers at the head piece of the derrick boom and from there back to the head piece of the derrick boom and then to the end of the guide frame. The end of the ropes is advantageously connected to the carriage.

The traveling gear is usually a crawler unit. The invention is, however, not limited to a crawler unit.

The traveling gear can be configured as eccentric with respect to the center of rotation of the crane so that the spacing between the center of rotation of the crane and the ballast box is maximized with a simultaneous minimization of the radius. To ensure the stability of the undercarriage with a corresponding eccentric configuration of the traveling gear, additional ballast can be deposited on one side of the undercarriage.

Within the framework of the present invention, the ballast can be automatically transposed on the preferably curved guide frame.

Alternatively, the ballast can also be moved on a straight guide frame in accordance with the invention. In this case, the ballast must be displaced along the track. A separate drive, which preferably comprises hydraulic cylinders, serves for this purpose. The ballast is to be displaced via this drive in dependence on the radius.

Overall, the ballast box can be relieved by the arrangement in accordance with the invention so that a smaller ballast box is required for the counterweight. The relief takes place in accordance with the invention in that the ballast weight

- is received by the crane undercarriage and the ballast box in the non-deflected state;
- is received by the ballast box and the rope connection to the derrick boom in the deflected state; and
- produces a relatively large resisting moment since it is deflected.

The invention relates to a lattice mast crane, wherein the track for the ballast projects outwardly beyond the ballast box.

BRIEF DESCRIPTION OF THE DRAWINGS

Further features, details and advantages of the invention will be explained in more detail in the form of an embodiment with respect to the drawing. There are shown.

DESCRIPTION OF THE PREFERRED EMBODIMENTS

Figure 1:
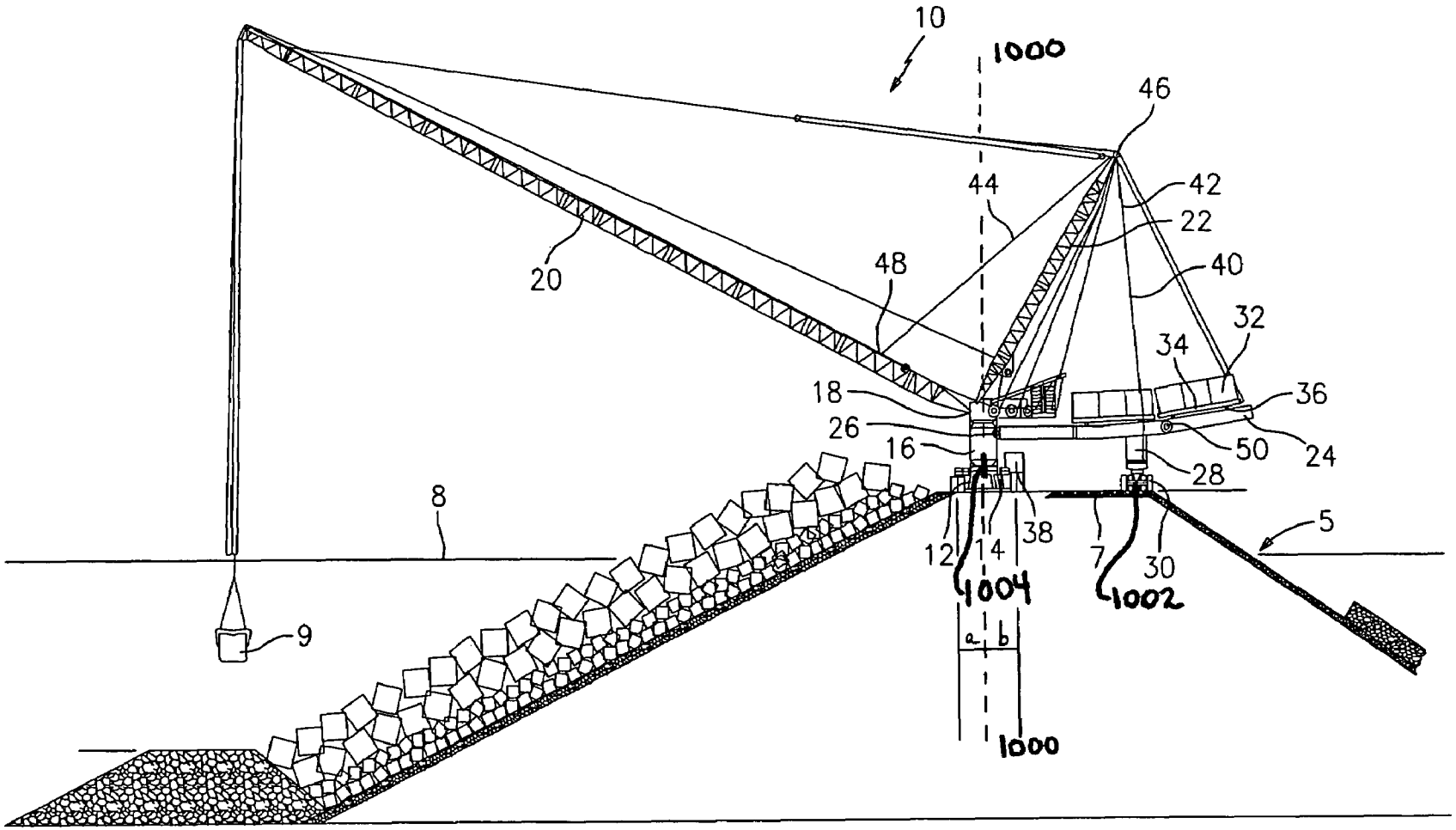
FIG. 1: a representation of a lattice mast crane in accordance with an embodiment of the present invention in use on a dam crest.

In FIG. 1, a dam 5 is shown whose dam crest 7 is made as a traffic road. A lattice mast crane 10 is on the dam crest 7 and concrete blocks 9, which can have a total weight of approximately 150 t, can be sunk into the sea to form wave protection using it. The water surface is indicated by the boundary line 8. The lattice mast crane 10 has a traveling gear made as a crawler unit 12 on which a swiveling crown 14 is supported. A revolving deck 18 is mounted on the swiveling crown 14 via a spacer tube 16, which includes a slewing gear transmission 1004 disposed in a lower region thereof. A main boom 20 and a derrick boom 22 are hinged to the revolving deck 18 in a known manner. The plane of rotation of the revolving deck is just above the crawler unit 12. The spacer tube 16 and the revolving deck 18 are therefore fixedly connected to one another. A guide frame 24 is hinged around a pivot joint 26 at the upper end of the spacer tube and is connected to a ballast box 30 via a spacer frame 28. The guide frame 24 is itself fixedly connected to the spacer frame 28. The spacer frame 28 is in turn connected to the ballast box 30 via a single rotary axle 1002 so that the ballast box 30 can rotate with respect to the guide frame 24 on an inclined position of the ballast box due to uneven ground.

It is ensured by the pivoting of the guide frame 24 to the upper end of the spacer tube 16 and by the interposition of the spacer frame 28 between the ballast box 30 and the guide frame 24 that sufficient space remains on the dam crest 7 between the crawler unit 12, on the one hand, and the ballast box 30, on the other hand, so that construction site traffic can continue despite the use of the lattice mast crane 10.

As shown in the Figure, the guide frame 24 projects beyond the ballast box 30. The ballast is arranged on the guide frame 24. Based on this construction, a comparatively high resisting moment can be generated despite the comparatively tight ballast box radius by placing the ballast on the part of the guide frame projecting over the ballast box. Carriages 34 are arranged on the guide frame 24 for the reception of the derrick ballast 32. The carriages can be displaced in the longitudinal direction of the guide frame via rollers 36 on rails which are fastened to the guide frame 24. In this connection, the guide frame 24 is, as shown in the Figure, configured to be curved so that the carriages 34 are displaceable with the ballast 32 along this curved track along the longitudinal direction of the guide frame, as will be explained again in detail in the following.

For the further minimization of the ballast box radius, the crawler unit 12 is made eccentric with the respect to the center of rotation of the lattice mast crane 10. As such, an axis 1000 of crawler unit 12 is a distance a from left hand track, as shown in FIG. 1, and a distance b from the right hand track. Distance a is smaller than distance b so that crawler unit 12 is eccentric to the center of rotation of lattice crane 10. The eccentricity is made such that the spacing between the ballast box 30 and the center of rotation of the crane is maximized, whereas the radius of the ballast box 30 is minimized. To ensure a secure standing position of the crawler unit 12 with this eccentric configuration, an additional ballast 38 is placed on the wide crawler side. The guide frame is connected, on the one hand, to the head piece of the derrick boom 22 by means of fixed guying 40 so that the load torque can be introduced directly into guide frame 24, and thus into the derrick ballast 32, via this fixed guying 40. A cylinder 42 can be arranged at the upper end of the guying 40.

Two additional ropes 44 are fastened to the boom 20 to the right and left with respect to the axis of symmetry of the crane. They are guided from there via rollers 46 at the head piece of the derrick boom to the end of the guide frame 24. They are in turn guided back from there to the head piece of the derrick boom 22 and back to the guide frame again, with the ends of the ropes in each case being connected to the carriage 34.

The pivot point 48 of the ropes 44 at the main boom is selected such that, on the luffing down of the main boom 20 into the lowest operating position, the ballast box has arrived at the topmost end of the guide frame 24. On the luffing up into the steepest operating position, the ballast box 34 rolls over the curved track into the lower position up to an abutment not shown in any more detail in the drawing so that the ropes 44 are completely relaxed. In this steep position, the ropes 44 can, for example, be separated, i.e. unbolted, from the carriage 34. After the connection to an auxiliary rope which is not shown in any more detail in the drawing and which is wound onto auxiliary winches 50, the boom 20 can be let down, with the auxiliary rope being pulled into the rear reeving of the rope 44. The main boom 20 can thus be completely let down to the ground for servicing and repair work, for example. The curvature of the guide frame 24 is selected such that, with a steep position of the main boom 20, only a very low downhill force is produced, i.e. the force in the rope 44 is very low and the steeply standing boom, which only generates a low load torque to the front, is only pulled backward to a very low degree.

If the boom has arrived at its lowest operating position, the ballast box is again in the uppermost operating position. The curvature of the road surface is much larger here, as can be seen from the Figure. The downhill force, and thus also the rope force 44, is greatly increased. Two positive effects can hereby be achieved:

On the one hand, the main beam 20, which is downwardly deflected due to its own weight, is upwardly relieved. Furthermore, a relatively high upward force is generated, which engages at the end of the guide frame, via the reeving of the rope 44 between the boom head of the derrick boom 22 and the end of the guide frame 24. Some of the derrick ballast is thus pulled upward and the remaining load of the ballast box 30 is reduced such that the ballast box 30 is not overloaded.

It is now possible based on the invention to use the ballast box with a substantially smaller ballast box radius and to displace the ballast outwardly on the projecting, curved track of the guide frame 24 to generate the required resisting moment.

Figure 2:
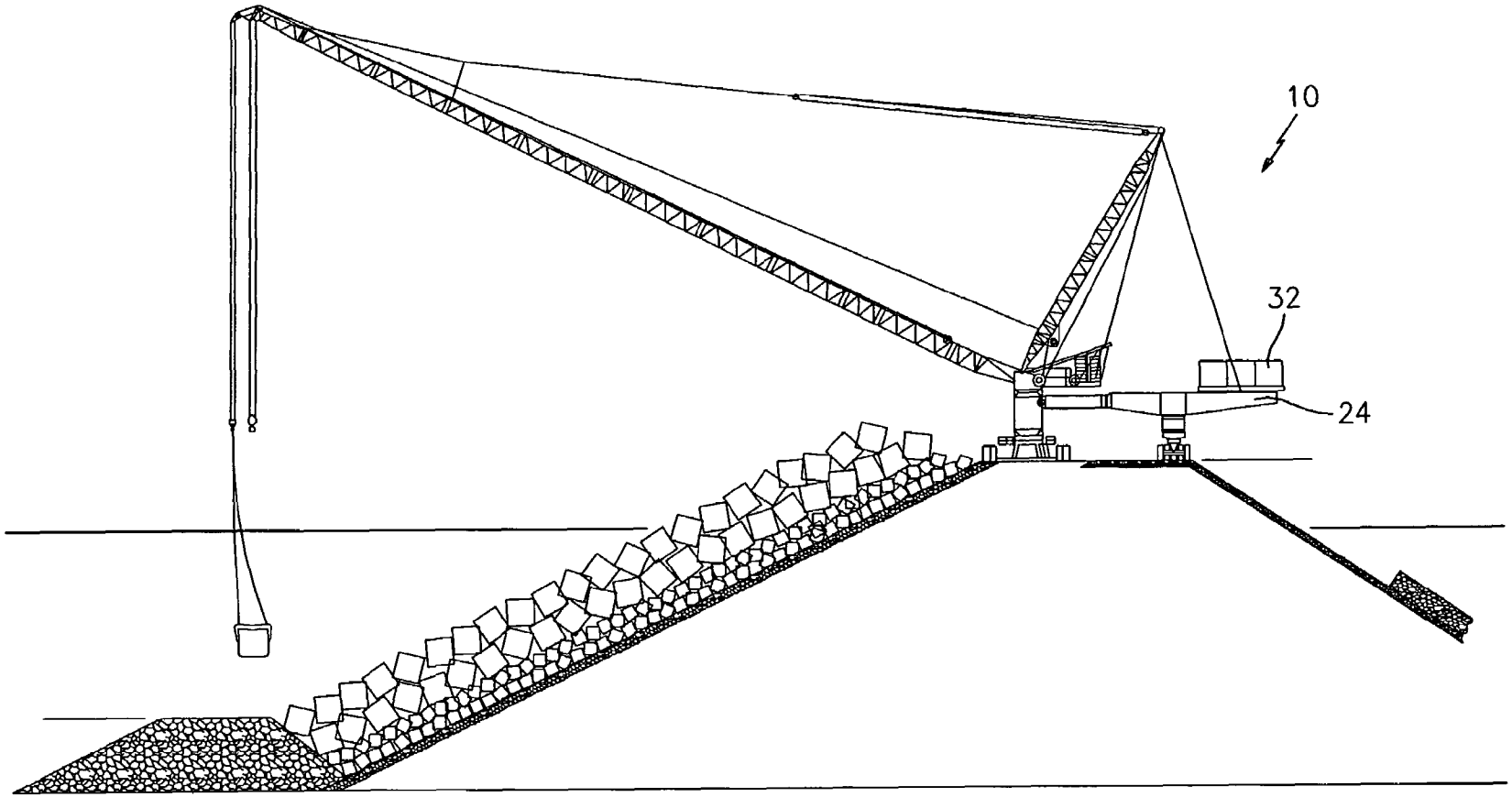
FIG. 2: a representation in accordance with FIG. 1 of an alternative embodiment of a lattice mast crane.

The lattice mast crane shown in FIG. 2 substantially corresponds to the design of the lattice mast crane already described in detail with reference to FIG. 1. The derrick ballast 32 is, however, moved on a straight guide frame 24. This is done via a separate drive not shown in any more detail in FIG. 2, in the present case by hydraulic cylinders. The stability of the crane is monitored via a control likewise not shown, with permitted ranges being predetermined in a known manner by the control. The derrick ballast 32 is then displaced in dependence on the radius. The displacement of the derrick ballast can alternatively be carried out by the crane operator or by the automatic control.

The invention claimed is:

1. A lattice crane having a traveling gear, a swiveling crown arranged on the traveling gear and a revolving deck mounted on a spacer tube, which is arranged on the swiveling crown and rotatable via the swiveling crown and on which a main lattice boom and a derrick boom are arranged;

a guide frame pivotally connected to the spacer tube and mounted with a spacer frame, which is arranged with a ballast box, the ballast box being pivotable relative to the guide frame; and at least one carriage being arranged on and movable relative to the guide frame, the at least one carriage being configured to support ballast.

2. A lattice crane in accordance with claim 1, wherein the guide frame is pivoted via a hinge at the spacer tube and fixedly mounted with the spacer frame.

3. A lattice mast crane in accordance with claim 2, wherein the spacer frame is connected to the ballast box via a single rotary axle.

4. A lattice crane in accordance with claim 3, wherein the guide frame projects beyond the ballast box.

5. A lattice crane in accordance with claim 4, wherein a slewing gear transmission is arranged in the a lower region of the spacer tube.

6. A lattice crane in accordance with claim 3, wherein a slewing gear transmission is arranged in the lower region of the spacer tube.

7. A lattice crane in accordance with claim 2, wherein the guide frame projects beyond the ballest box.

8. A lattice crane in accordance with claim 2, wherein the slewing gear transmission is arranged in a lower region of the spacer tube.

9. A lattice crane in accordance with claim 1, wherein the guide frame projects beyond the ballest box.

10. A lattice crane in accordance with claim 1, wherein a slewing gear transmission is arranged in a lower region of the spacer tube.

11. A lattice crane in accordance with claim 1, wherein a carriage is provided on the guideframe for the reception of derrick ballest.

12. A lattice crane in accordance with claim 11, wherein the carriage is displaceable by rollers on rails fastened the guide frame.

13. A lattice crane in accordance with claim 1, wherein the guide frame is divided at least into two sections.

14. A lattice crane in accordance with claim 1, wherein the guide frame is connected to a head piece of the derrick boom by a fixed guying.

15. A lattice crane in accordance with claim 1, wherein at least two ropes fastened to the main boom at the right and at the left with respect to the axis of symmetry of the crane are guided via rollers at a head piece of the derrick boom to the guide frame, back to the head piece of the derrick boom from there and then to the end of the guide frame.

16. A lattice crane in accordance with claim 15, wherein the ropes are connected to the crane.

17. A lattice crane in accordance with claim 1, wherein the traveling gear is a crawler unit.

18. A lattice crane in accordance with claim 1, wherein the traveling gear is eccentric with respect to the center of rotation of the crane so that the spacing between the center of rotation of the crane and the ballast box is maximized with a simultaneous minimization of the radius.

19. A lattice crane in accordance with claim 18, wherein an additional ballast is deposited on one side of the traveling gear for the securing of stability.

20. A lattice crane having a traveling gear, a swiveling crown arranged on the traveling gear and a revolving deck mounted on a spacer tube, which is arranged on the swiveling crown and rotatable via the swiveling crown and on which a main lattice boom and a derrick boom are arranged, a guide frame pivotally connected to the spacer tube and mounted with a spacer frame, which is arranaed with a ballast box, the ballast box being pivotable relative to the guide frame, and at least one carriage being arranged on and movable relative to the guide frame, the at least one carriage being configured to support ballast, wherein the guide frame forms a track such that the at least one carriage projects outwardly beyond the ballast box.

* * * * *